United States Patent [19]

McKee et al.

[11] Patent Number: 4,679,018

[45] Date of Patent: Jul. 7, 1987

[54] CIRCUIT BREAKER WITH SHOCK RESISTANT LATCH TRIP MECHANISM

[75] Inventors: Jere L. McKee, Scott Township, Lawrence County; Glenn R. Thomas, Brighton Township, Beaver County, both of Pa.

[73] Assignee: Westinghouse Electric Corp., Pittsburgh, Pa.

[21] Appl. No.: 818,947

[22] Filed: Jan. 15, 1986

[51] Int. Cl.[4] ..... H01H 71/14

[52] U.S. Cl. ..... 335/167; 335/22; 335/23; 335/35; 335/169; 335/191

[58] Field of Search ..... 335/6, 21, 22, 23, 35, 335/167, 169, 191

[56] References Cited

U.S. PATENT DOCUMENTS

| | | | |
|---|---|---|---|
| 3,264,428 | 8/1966 | Hollyday | 335/35 |
| 3,462,716 | 8/1969 | Yorgin et al. | 335/23 |
| 3,492,614 | 1/1970 | DeAngelo et al. | 335/191 |
| 3,786,382 | 1/1974 | Powell | 335/169 |
| 3,805,199 | 4/1974 | Tazuki | 335/191 |
| 3,928,826 | 12/1975 | Maier et al. | 335/22 |
| 4,368,444 | 1/1983 | Preuss et al. | 335/169 X |
| 4,503,408 | 3/1985 | Mrenna et al. | 335/35 |
| 4,550,300 | 10/1985 | Jencks et al. | 335/22 X |

*Primary Examiner*—Arthur T. Grimley
*Assistant Examiner*—Jane K. Lau
*Attorney, Agent, or Firm*—L. P. Johns

[57] ABSTRACT

A circuit breaker apparatus characterized by a molded case containing a circuit breaker structure for opening and closing a circuit which structure comprises a releasable lever operable between latched and unlatched positions corresponding to open and closed circuit conditions, latch means including a latch lever for the releasable lever, interconnected toggle connected to the latch lever and that are biased to the unlatched position of the lever, and a movable trip bar responsive to predetermined overcurrents and having a projection contacting the toggle links for holding the links in the unbiased position.

4 Claims, 5 Drawing Figures

CIRCUIT BREAKER WITH SHOCK RESISTANT LATCH TRIP MECHANISM

BACKGROUND OF THE INVENTION

1. Field of the Invention

This invention relates to a molded case circuit breaker and, more particularly, it pertains to latching and tripping mechanism which utilizes a series of linkages.

2. Description of the Prior Art

Molded case circuit breakers are designed to provide circuit protection for low voltage distribution systems. They protect connected apparatus against overload and/or short circuits. The proper breaker for a specific application can be selected by determining a few parameters, such as voltage, frequency, interrupting capacity, continuous current ratings, and unusual operating conditions. When a circuit breaker is applied where there is a possibility of high shock, a special anti-shock device should be used. Such a device may consist of inertia weight over the center pole for holding the trip bar latched under shock conditions without preventing thermal or magnetic trip units from functioning on overload and short circuit. The U.S. Navy is the largest user of high shock breakers which are required on all combat ships.

SUMMARY OF THE INVENTION

In accordance with this invention, a circuit breaker having a shock resistant latch trip mechanism is provided which comprises a pair of separable contacts operable between open and closed positions, a mechanism for operating the contacts and comprising a pivotally supported releasable arm, means for latching the releasable arm and including a latch lever and a pair of pivot links that are pivotally interconnected to form a toggle joint for movement of the latch lever between latched and unlatched positions of the releasable arm, means including a trip bar for releasably moving the links into the latched position, the pivot links being movable between aligned and unaligned positions corresponding to latched and unlatched positions of the releasable arm and being spring-biased in the unaligned position, the trip bar being rotatably mounted for moving the links into the aligned position, the latch lever being pivotally connected to the end of one link, and a toggle joint comprising an inclined surface engageable by the trip bar for moving the links to the aligned position, whereby the mechanism is highly resistant to shock forces while permitting the trip forces to be controlled to reasonable values.

DESCRIPTION OF THE PREFERRED EMBODIMENT

Figure 1:
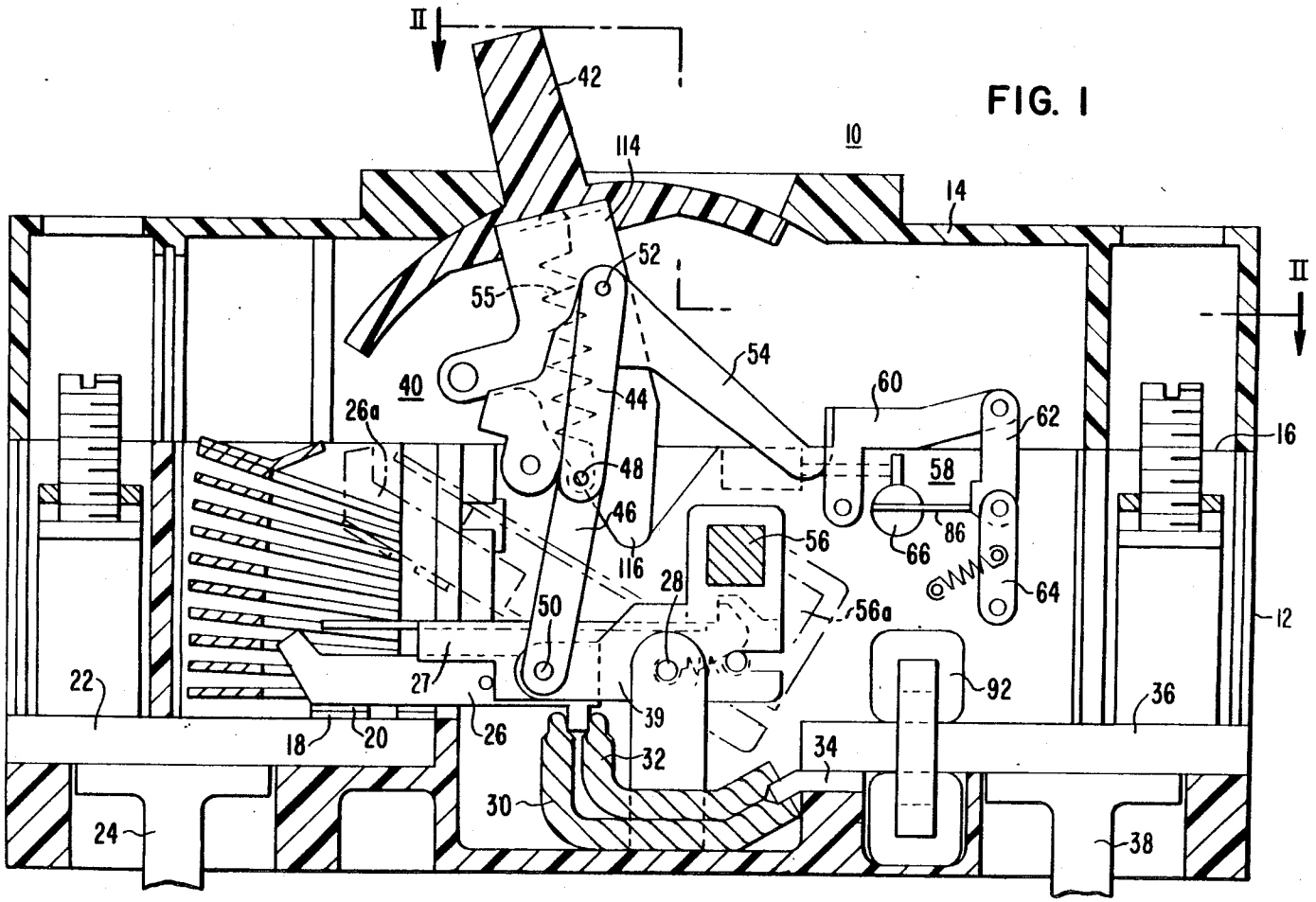
FIG. 1 is a vertical sectional view through a circuit breaker in a contact closed position and showing the latch trip mechanism of this invention.

A molded case circuit breaker is generally indicated at 10 in FIG. 1 and it comprises a base 12 having a cover 14. The base and the cover are assembled at a parting line 16 and create an internal compartment in which circuit breaker apparatus is disposed which includes a fixed contact 18 and a movable contact 20. The fixed contact is mounted on a conductor 22 to which a stab 24 is connected.

The movable contact 20 is mounted on a contact carrying arm 26 which is pivotally mounted on pivot 28. A pair of flexible conductors, or shunts 30, 32 extend from the arm 26 to a connector 34 of a conductor 36 which conductor is connected to a stab 38. Thus, a circuit through the circut breaker extends from the stab 24 through the several parts 22, 18, 20, 26, 30, 32, 34, 36 to the stab 38.

Figure 2:
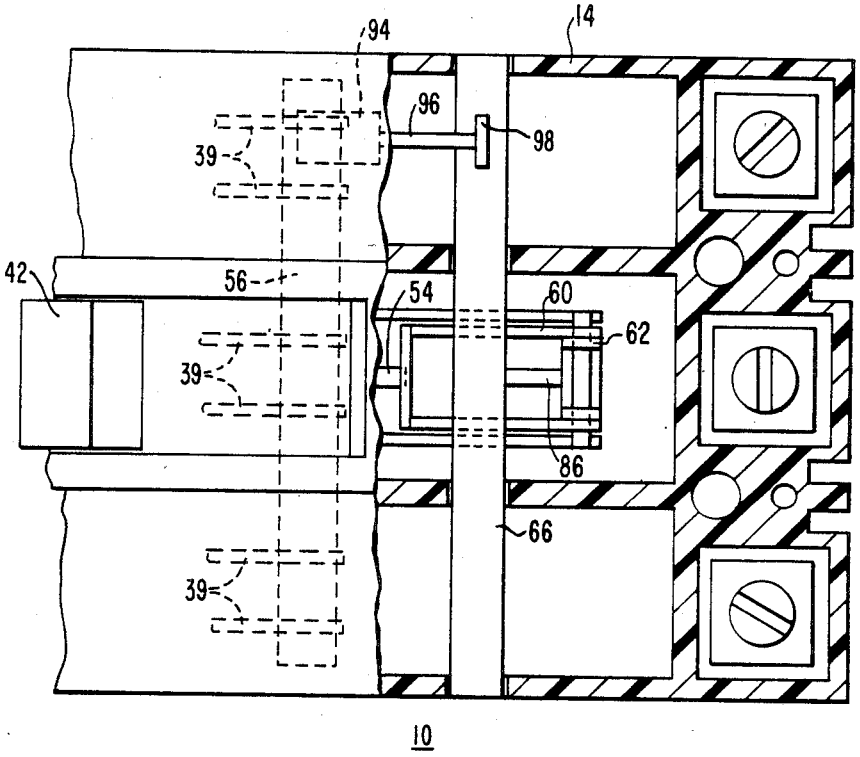
FIG. 2 is a horizontal sectional view taken on the line II—II of FIG. 1.

As shown in FIG. 1 the pin 28 is a pivotal point for rotation of a contact arm assembly and a mounting bracket 39 comprised of a pair of similar spaced plates (FIG. 2) fixedly mounted on the crossbar 56. The contact arm assembly includes the contact arm 26 and a switch arm 27 which is an inverted channel member and within which the contact arm is disposed. In effect the assembly of the contact arm 26 and the switch arm 27 comprise the operating contact arm. The switch arm 27 is pivotally mounted on the pin 28 on which it is independently rotable with the mounting bracket 39. Latching means are provided between the switch arm and the bracket for releasably maintaining them together for simultaneous or separate movement.

An operating mechanism generally indicated at 40 is provided for opening and closing the contacts by means of a conventional toggle assembly which includes toggle links 44, 46 which are pivotally interconnected at pivot 48. Link 46 is pivotally connected at pivot 50 to the mounting bracket 39. The link 44 is pivotally connected at pivot 52 to a releasable arm or cradle 54. The toggle mechanism also includes a coil spring 55 in a conventional manner.

Opening of the contacts 18, 20 is accomplished either by the handle 42 or automatically in response to overcurrent conditions occuring in the circuit.

In the open position, the contact arm 26 is disposed in a broken line position **26*a*. The mounting bracket 39 supports a crossbar 56 which is interconnected with contact arms in adjacent pole units of the three-pole circuit breaker 10 (FIG. 2) for opening and closing corresponding contacts similar to contacts 18, 20, simultaneously. Accordingly, when the operating mechanism 40 actuates the contact arm 26 between either open or closed positions, the contact arms in adjacent poles of the circuit breaker are moved correspondingly by the operating mechanism 40**.

In accordance with this invention, the circuit breaker 10 also comprises a latching device generally indicated at 58 and it comprises a latch lever 60, a pair of links 62, 64, and a trip bar 66. As shown more particularly in FIG. 3, the links 62, 64 are pivotally interconnected at pivot 68 forming a toggle joint. The lower end of the link 64 is pivoted at 70 to a frame member 72 and the upper end of the link 62 is pivotally connected at 74 to the latch lever 60, which lever is pivoted at 76 to the frame 72.

Figure 3:
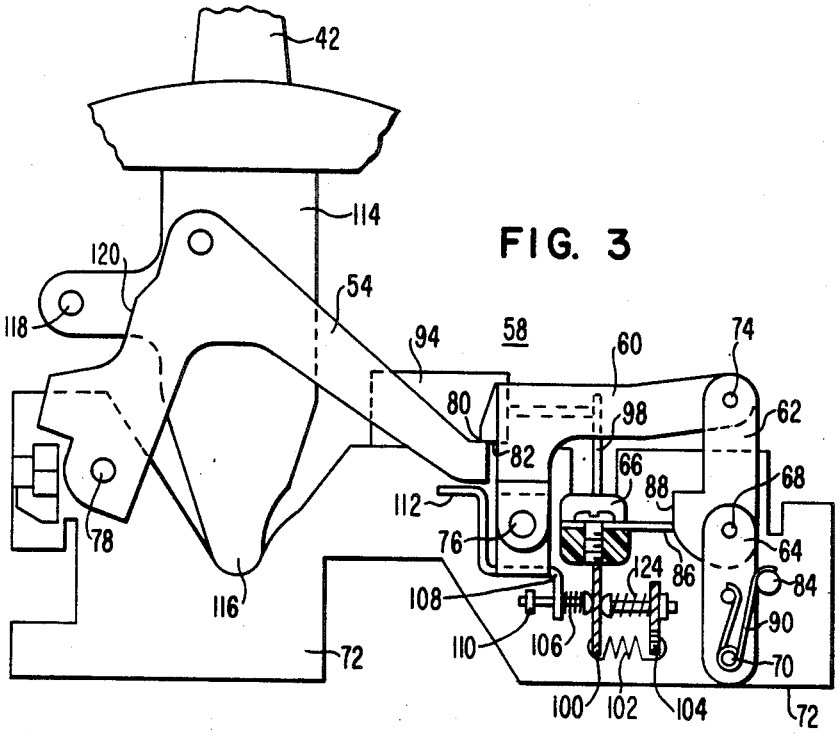
FIG. 3 is an enlarged fragmentary view showing the latch trip mechanism in the latched position.

In FIG. 3 the latching device 58 is disposed in the latched position of the cradle 54 which is pivotally mounted to the frame 72 at pivot 78. That is, end 80 of the cradle 54 is retained in place by a surface 82 of the latch lever 60, which lever is retained in place by the links 62, 64 disposed in substantially aligned positions (FIG. 3). The links 62, 64 are retained in that position against a stop pin 84 by pressure from a lever 86 extending from a trip bar 66. So long as the latching device 58 remains in the latched position with respect to the cradle 54, the circuit breaker may be opened only by movement of the handle 42 to the "off" position.

However, when in the response to overcurrent conditions, such as a short circuit, the trip bar 66 is rotated clockwise to move the lever 86 from contact with the surface 88 of the link 62, whereby a bias spring 90 rotates the toggle link to the left (FIG. 3), causing the latch lever 60 to rotate clockwise. As a result, the latch lever 60 rotates clockwise to release the cradle 54 which rotates counterclockwise in response to pressure of springs in the toggle linkage of the operating mechanism 40 to the position shown in FIG. 4. Thus, the circuit breaker 10 is tripped and the latching device 58 assumes the condition shown in FIG. 4.

Automatic tripping of the circuit breaker occurs in response to overcurrent conditions which may operate at least one device, such as a bimetal, electromagnet, or a current transformer. For example, a current transformer 92 (FIG. 1) is disposed around the conductor 36. When a current exceeding a prescribed rating passes through the conductor 36, the current transformer 92 feeds an electronic trip unit (not shown) which, in turn, actuates a solenoid 94 (FIG. 5) having a plunger 96 which moves against a lever 98 for rotating the trip bar clockwise.

Figure 4:
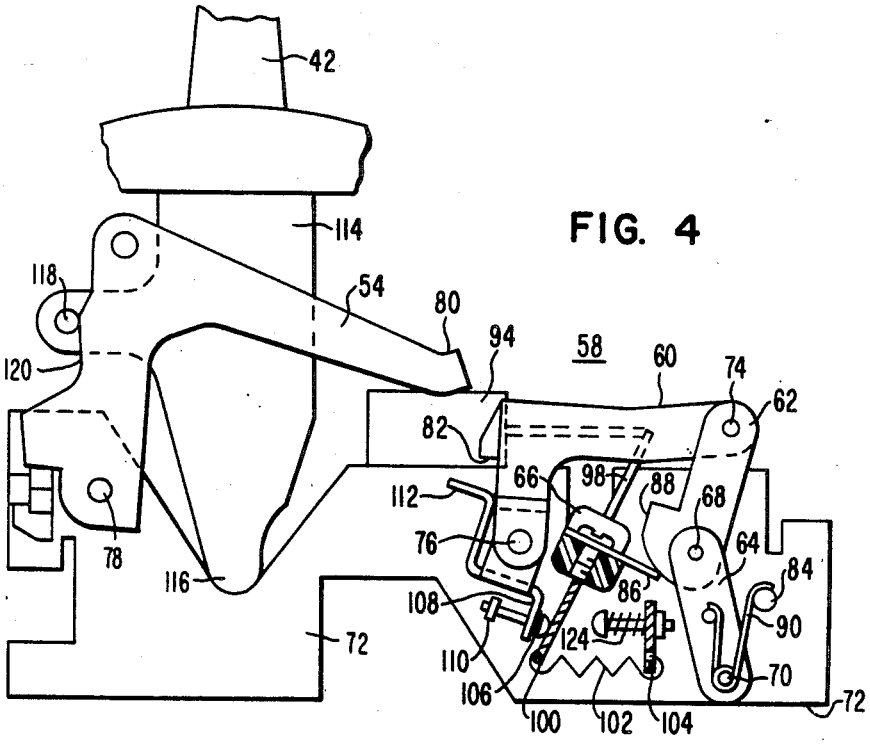
FIG. 4 is an enlarged fragmentary view of the latch trip mechanism in the unlatched position.

When the trip bar 66 is rotated clockwise, the lever 86 moves off the surface 88 and the combination of the pressure applied by the cradle 54 and the spring 90 collapses the latching device 58 to the position shown in FIG. 4. As the trip bar 66 rotates, a lever 100 (FIG. 4) mounted thereon, stretches a coil spring 102, one end of which is attached to the lower end of the lever 100 and the other end of which is attached to a frame member 104, thereby providing a bias for returning the trip bar 66 in the latching device 58 to the latched position.

In addition, the lever 100 bears against a spring-loaded pin 106 mounted on a bracket 108 which is pivotally mounted on the pin 76. The pin 106 is slidably mounted on a flange of the bracket 108 where it is retained by a nut 110. The bracket 108 is a generally Z-shaped member having a flange 112.

Figure 5:
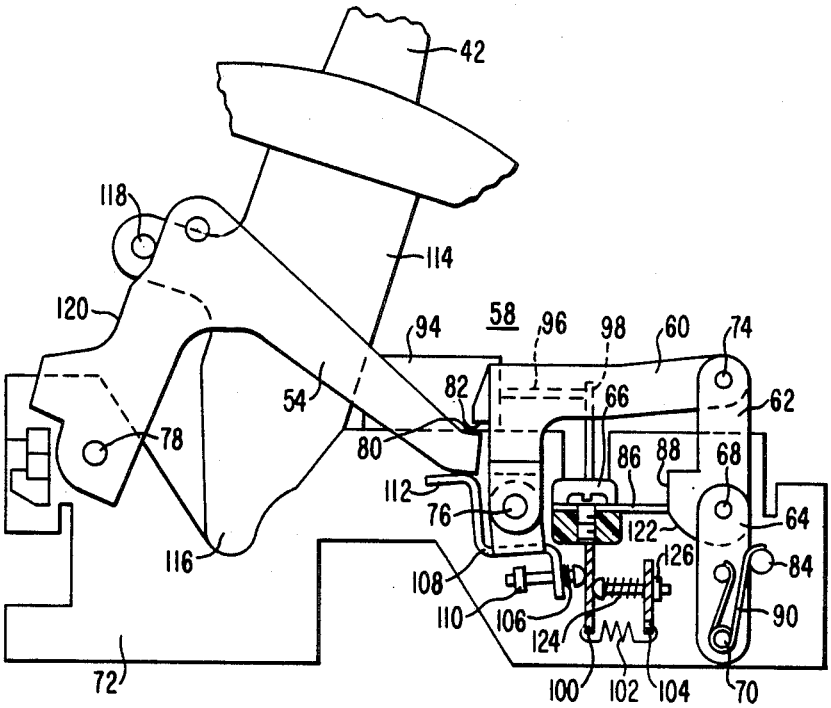
FIG. 5 is an enlarged, fragmentary side view of the resetting position.

Resetting the circuit breaker 10 occurs by rotating the handle 42 (FIG. 1) clockwise to rotate an inverted U-shaped operating lever 114 about a pivot 116, causing a pin 118 on the lever to move against an edge 120 (FIG. 4) to rotate the cradle 54 clockwise to the position shown in FIG. 5. Thus, the right end of the cradle 54 engages the flange 112 and rotates the bracket 108 and the spring-loaded pin 106 against the lever 100, whereby the trip bar 66 rotates counterclockwise. That action causes the lever 86 to move over an inclined or camming surface 122, thereby urging the toggle links 62, 64 back to the latched condition. The latch surface 82 of the latch lever 60 is positioned in the path of movement of the end 80 of the cradle 54 for latching the cradle when the handle 42 is released.

A spring-loaded pin 124 is slidably mounted on the frame member 104 for establishing a setting position for the lever 100. For that purpose a nut 126 is adjustably mounted on the pin 124 for making adjustments of the position of the lever. Rotation of the cradle arm 54 to the position shown in FIG. 5 for rotating the bracket 108 moves the lever 98 against and the plunger 96 into a retracted position within the solenoid 94. In this position, the plunger 96 is ready for a subsequent tripping of the latching device 58.

In conclusion, the latching and tripping mechanism of this invention utilizes a series of linkages which offer the advantages of low latch loads, high shock resistance, and minimum adjustments to provide high resistance to shock forces while allowing the trip forces to be controlled to reasonable values.

What is claimed is:

1. A circuit breaker comprising:

(a) a housing including a mounting frame;

(b) a circuit breaker structure having a pair of separable contacts and having a releasable lever operable between latched and unlatched positions to open the separable contacts;

(c) operating means for actuating the contact arm and comprising a first toggle linkage between the releasable lever and the contact arm;

(d) manually operable means to open and close the contacts when the releasable lever is in the latched position;

(e) a trip bar operable automatically in response to overload current conditions above a predetermined value to release the releasable lever from the latched position to the unlatched position to open the contacts, (f) latching means for latching the releasable lever including a latch lever detachably connected to the releasable lever;

(g) the latching means also including a second toggle linkage comprising a first link pivotally connected to the latch lever, a second link pivotally connected to the mounting frame, and the first and second links having pivotally connected end portions forming a pivot joint;

(h) the trip bar having a projection for releasably engaging the second toggle linkage so as to cause latching and unlatching of the releasable lever upon rotation of the trip bar; and (i) the manually operable means being operable to move the releasable lever from the tripped position to the latched position following release of the releasable lever.

2. The circuit breaker of claim 1 in which the end portion of one of the links of the second toggle linkage includes a camming surface over which the projection moves to relatch the releasable lever as the manually operable means moves to reset the trip bar.

3. The circuit breaker of claim 2 in which the links of the second toggle linkage are aligned against a stop pin by the projection.

4. The circuit breaker of claim 3 in which the links of the second toggle linkage are biased away from the stop pin.

* * * * *